United States Patent [19]

Kinser

[11] 4,277,925

[45] Jul. 14, 1981

[54] SIMULATED LOG BUILDING STRUCTURE

[76] Inventor: C. Wayne Kinser, 87 W. Oakview Rd., Asheville, N.C. 28806

[21] Appl. No.: 35,987

[22] Filed: May 4, 1979

[51] Int. Cl.[3] ..... E04B 1/10

[52] U.S. Cl. ..... 52/233; 52/314

[58] Field of Search ..... 52/233, 314

[56] References Cited

U.S. PATENT DOCUMENTS

| | | | |
|---|---|---|---|
| 1,402,438 | 1/1922 | Nichols | 46/20 |
| 1,510,326 | 9/1924 | Locke | 46/20 |
| 1,996,735 | 4/1935 | King | 52/233 |
| 2,110,787 | 3/1938 | Brandjord | 52/233 |
| 2,130,231 | 9/1938 | Forciea | 52/233 |
| 2,463,612 | 3/1949 | Grudda | 52/233 |
| 3,350,827 | 11/1967 | Sugar | 52/315 X |
| 3,552,079 | 1/1971 | Mortensen | 52/233 X |
| 4,012,876 | 3/1977 | Gruffs | 52/233 |
| 4,185,428 | 1/1980 | Bourquey et al. | 52/233 |

FOREIGN PATENT DOCUMENTS

| | | | |
|---|---|---|---|
| 186837 | 6/1907 | Fed. Rep. of Germany | 52/233 |
| 2535980 | 2/1976 | Fed. Rep. of Germany | 52/233 |
| 1141606 | 3/1957 | France | 52/233 |
| 428177 | 1/1967 | Switzerland | 52/233 |

*Primary Examiner*—Alfred C. Perham
*Attorney, Agent, or Firm*—Donald D. Denton

[57] ABSTRACT

A building structure having outer walls and corner elements that simulate a log-type building, the corner elements having a plurality of alternate wedge-shaped blocks that project at an angle with respect to each other, and a plurality of log facing elements spaced from each other by a mortar joint spacer element, the mortar joint spacer elements abutting centrally the wedge-shaped blocks that project normal to the plane of said mortar joint spacers.

18 Claims, 7 Drawing Figures

SIMULATED LOG BUILDING STRUCTURE

BACKGROUND OF THE INVENTION

This invention is concerned with building elements incorporated in the construction of a simulated log building structure or prefabricated component parts of a simulated log building structure. More particularly, it relates to three elements that form simulated log building walls joined together at their corners by a vertical corner unit adapted to match the wall section to form 90° corners which give the appearance of hand-hewn, dovetailed corners of a log-type building structure. These elements may be used by builders to construct the building on the job or may come as prefabricated sections that are erected on the job.

The concept of fabricating elements for use in a building structure remote from the building location is known in the art as are the buildings formed from the elements. Many types of building components have been made to give the appearance of a log building structure, particularly the interdigitated corner portions of the structure, such as shown in the patents to Nichols U.S. Pat. No. 1,402,438; to Locke U.S. Pat. No. 1,510,326; to King U.S. Pat. No. 1,996,735; to Brandjord U.S. Pat. No. 2,110,787; to Forciea U.S. Pat. No. 2,130,231; and to Mortensen U.S. Pat. No. 3,552,079. All of these patents cover log sections having notched ends that fit into each other when one log is positioned at a 90° angle to the other. The King patent further discloses the use of actual mortar on a metal lath backing between board and end blocks joined by a mitered joint to the ends of the board to simulate overlapping log ends.

SUMMARY OF THE INVENTION

The present invention contemplates a simulated log-type building structure that can be constructed easily and insulated to save energy by forming connecting wall sections, such as those that form corners, from three elements. The first element is a preformed log facing or veneer having a groove or lip running in both edges of the length of the log facing element; the second element is a mortar joint spacer that is adapted to fit into the grooves or against the lip of the log facing element; and the third element is a preformed or constructed dovetailed corner post. The three elements when assembled form the wall portions and corners of the building that simulate the appearance of walls built from logs that have caulking between the logs, as is present in log cabins.

The three elements may be shipped to the job and erected on stud framing or may be prefabricated and shipped to the job as wall sections and corner elements. The corner elements can then be assembled to form the walls of the building at the job site.

The log facing elements and mortar joint spacer elements are capable of being assembled with a minor amount of sawing and fabrication to produce a log cabin appearance of hand-hewn walls; and by matching the log facing elements and mortar joint spacers with a vertical corner section having cut mating blocks alternately angled, one protruding from the outer face of the other, a dovetailed corner effect is provided.

Accordingly, it is the object of this invention to provide a prefabricated building system having three elements or component parts for forming the walls of the building that, when assembled, give the building the appearance of a log home that has been custom built by hand-hewing the ends of logs and caulking between adjacent logs.

It is a further object of this invention to provide a novel corner post assembly that, when assembled in the structure such as by attaching to the stud framing, gives the appearance of hand-hewn dovetailed notched corners.

It is still a further object of the invention to provide log facing elements or boards and mortar joint spacer elements or boards that, when assembled, give the appearance of a log and mortar or board and mortar construction.

Another object is to provide for log facing boards having longitudinal running grooves or lips in adjacent edges adapted to accept mating edges of mortar joint spacer elements therein and in which the outer edge of the grooves may be of irregular form as opposed to a straight edge so as to give a realistic appearance of a natural log edge positioned against the mortar joint spacer board when the edge of the spacer board is inserted in the grooves.

It is still another object of the invention to provide a log-type structure that can be insulated to save energy without having an excessive wall thickness due to the diameter of the log that would normally be used in a building made from logs.

Another object of the invention is to provide an inner wall section that has log facing elements spaced by mortar joint spacer elements.

A still further object of the present invention is to provide a system and/or method for the fabrication of a simulated log-type building structure.

BRIEF DESCRIPTION OF THE DRAWINGS

These and other objects of this invention will become apparent when considering the appended specification and the drawings, in which.

DESCRIPTION OF THE PREFERRED EMBODIMENTS

Figure 1:
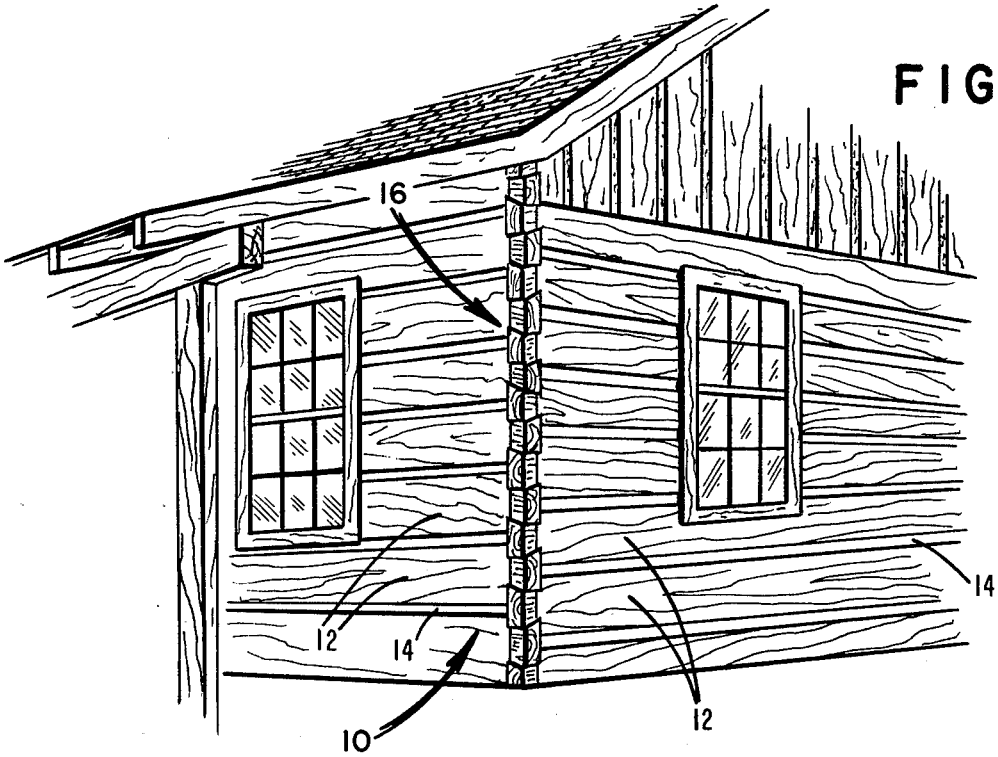
FIG. 1 shows a perspective view of a partial front and side of a simulated log structure having the unique building features of the present invention.
Figure 4:
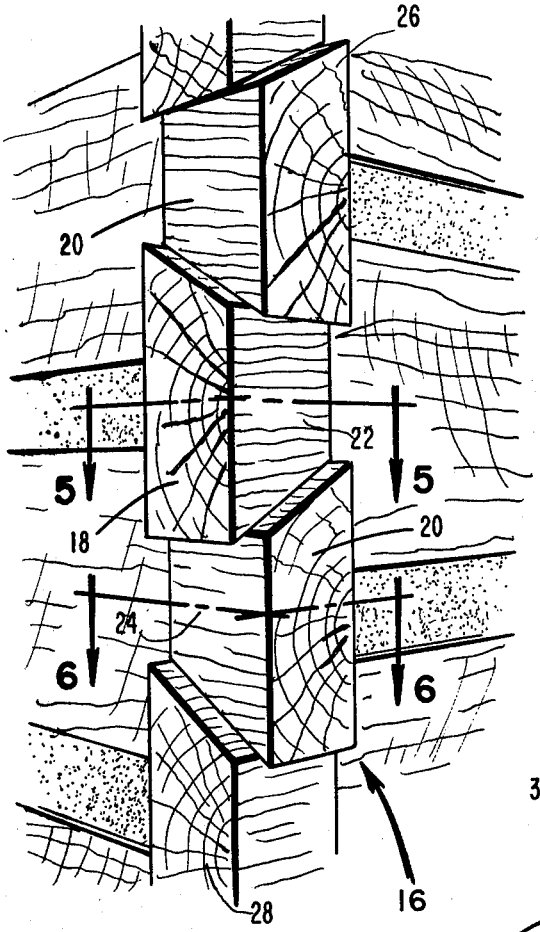
FIG. 4 shows a vertical view in perspective of the assembly arrangement of the component elements shown in FIG. 3 that form the corner of the building.

FIG. 1 illustrates a simulated log structure 10 that is produced by the method and from three structural elements or components forming a part of this invention. The structure includes a plurality of spaced log facing boards 12 as its first element, with a mortar joint spacer board 14 that is adapted to fit between adjacent log facing boards as the second element. The log facing boards or elements 12 and mortar joint spacer boards or elements 14 when assembled to form a wall abut a simulated dovetailed corner post 16 which is the third element. Thus there is formed from the three elements the abutting walls and corner of the structure. The corner post 16 is constructed so as to give the appearance of a dovetailed corner with respect to the log facing as is present in a log cabin type of structure (see FIG. 4).

The simulated dovetailed or wedge-shaped corner post 16 is formed from a right-hand set and a left-hand set of corner blocks 18,20, each set of blocks having two opposite parallel sides 22, 24, with any two of the abutting sides forming a substantially right angle, and two of the opposite sides being wider than the other two opposite sides to form in cross-section a rectangular section.

Figure 2:
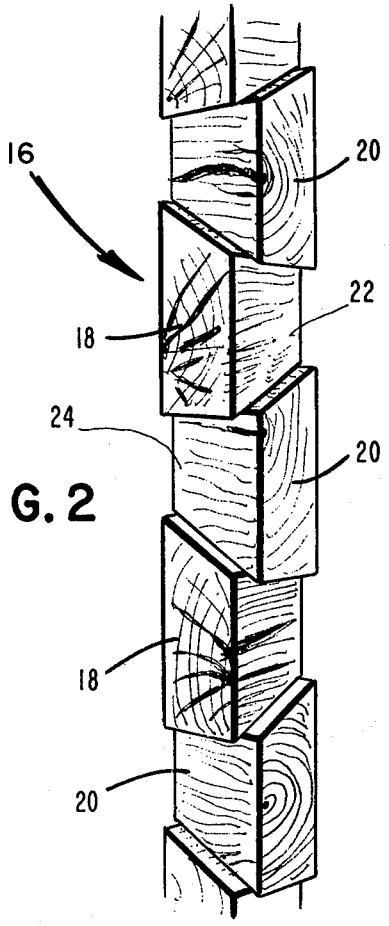
FIG. 2 shows a vertical perspective view of a prefabricated corner section used in the structure.

End portions 26, 28 of each set of blocks are at an equal angle to each other with the angle of one end portion being disposed 90° to the angle of the opposite end portion. The angular relationship of the end portions in each set of blocks is such that it is downwardly depending across the wide end of the block at one end and downwardly depending across the narrow end of the block at the other end. Each set of blocks has a lip portion 30 that extends from the edge of the surface of the block at its narrowest dimension, that is, where the surface of the angular portions intersect this narrowest dimension. One set of blocks form the left-hand corner while the other set of blocks form the right-hand corner when the blocks are assembled to form the dovetailed corner element 16. The end configurations of the left-hand and right-hand sets of blocks are opposite to one another as is shown in FIG. 2. Thus, when the two sets of blocks are assembled on a vertical support, one of the left-hand blocks is followed by one of the right-hand blocks, with their opposite mating angular surfaces resting against one another. This mating angular surface can be from about 20° to about 45° and cut so that when positioned in a corner element, the angular surfaces slope downwardly.

By assembling alternate left- and right-hand blocks, there is produced the dovetailed corner element or member with the end of one block projecting beyond the end of its adjacent block by the positioning of a wide end against a narrow end. This arrangement of the stacking of the blocks produces a corner having the appearance of crossed, interlocked, and socketed log ends at the corner where the two walls of the structure meet (see FIG. 2). The dovetailed corner element can be attached to or positioned in adjacent stud frame sections to which the log facing elements and mortar joint spacer elements can be attached.

It will be appreciated that the dovetailed corner element shown in FIG. 2 could be manufactured from one piece of lumber by jig milling the necessary angular projections and scarfing a small groove to simulate a meeting of the right- and left-hand blocks so that it would simulate the corner of crossed, interlocked, and socketed log ends.

Figure 3:
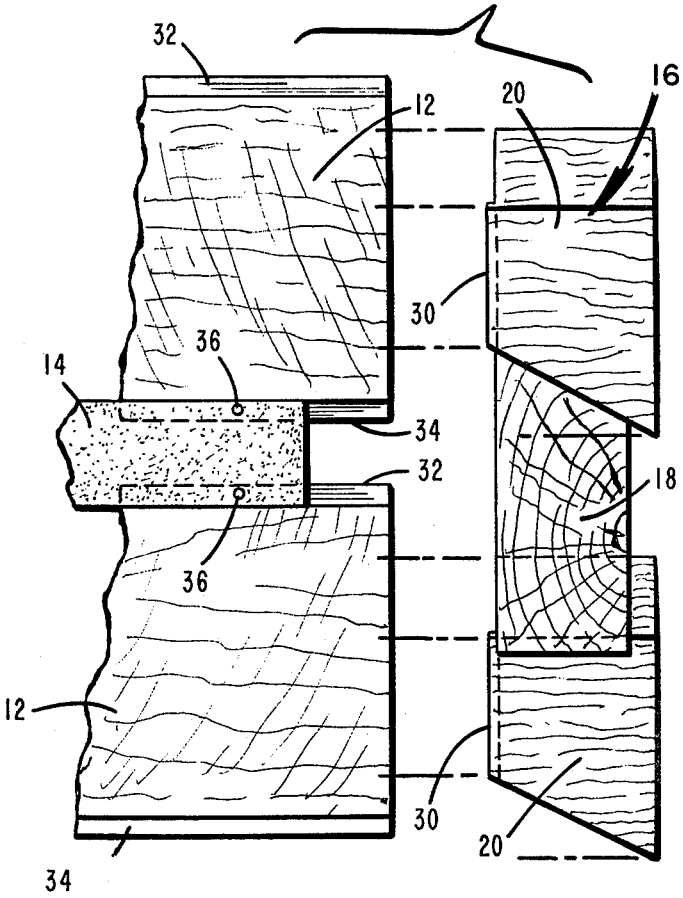
FIG. 3 is an exploded plan view of an assembly arrangement showing in spaced position two log facing elements with top and bottom lips, the mortar joint spacer board positioned against the top and bottom lips, and the positional arrangement of the log facing elements and the mortar joint spacer elements with respect to the two cut blocks that form the simulated dovetail corner.

FIG. 3 shows the arrangement of one-half of the corner element, two spaced log facing elements, and a mortar joint spacer element of the simulated log-type building of this invention. The building has a standard stud frame (not shown in this figure) to which is attached the dovetailed corner post element 16. Two spaced log facing elements 12 are provided with upper and lower lips or depressed edges 32, 34 which are spaced apart by mortar joint spacer element 14. The mortar joint spacer element 14 is positioned substantially central to a corner block 20, while adjacent upper and lower corner blocks 18 are positioned substantially central to the upper and lower edges of the log facing element 12. In this assembly, the log facing elements 12 are positioned against the stud frame with the ends of the log facing elements abutting blocks 18 and 20 and with a lip 30 or outwardly projecting member that is positioned on alternate blocks in one direction and on the other blocks in a direction that is rotated 90°. Each lip overlaps the ends of the log facing element 12 and the mortar joint spacer elements are positioned in depressed edges 32, 34 and abut only block 20. The spaced log facing elements are maintained in position by nails 36 that are driven through the mating edges of the log facing element and mortar joint spacer element and into a stud of the frame. The other wall attached to the other half of the dovetailed corner post element 16 has the mortar joint spacer element 14 abutting block 18 and the top and bottom edges of the spaced log facing elements 12 abut blocks 18 and 20 in the same manner as previously described. Thus a mortar joint spacer element 14 abuts only block 20 that is protruding out from the plane of the wall to which it is attached (see FIGS. 5 and 6). Thus there is produced a building structure in which the corner elements have a plurality of alternating wedge-shaped blocks positioned and projecting at an angle with respect to each other and a plurality of log facing elements spaced from one another by a mortar joint spacer element and abutting said wedge-shaped blocks, said mortar joint spacer element abutting centrally the wedge-shaped blocks that project normal to the plane of said mortar joint spacer.

Figure 7:
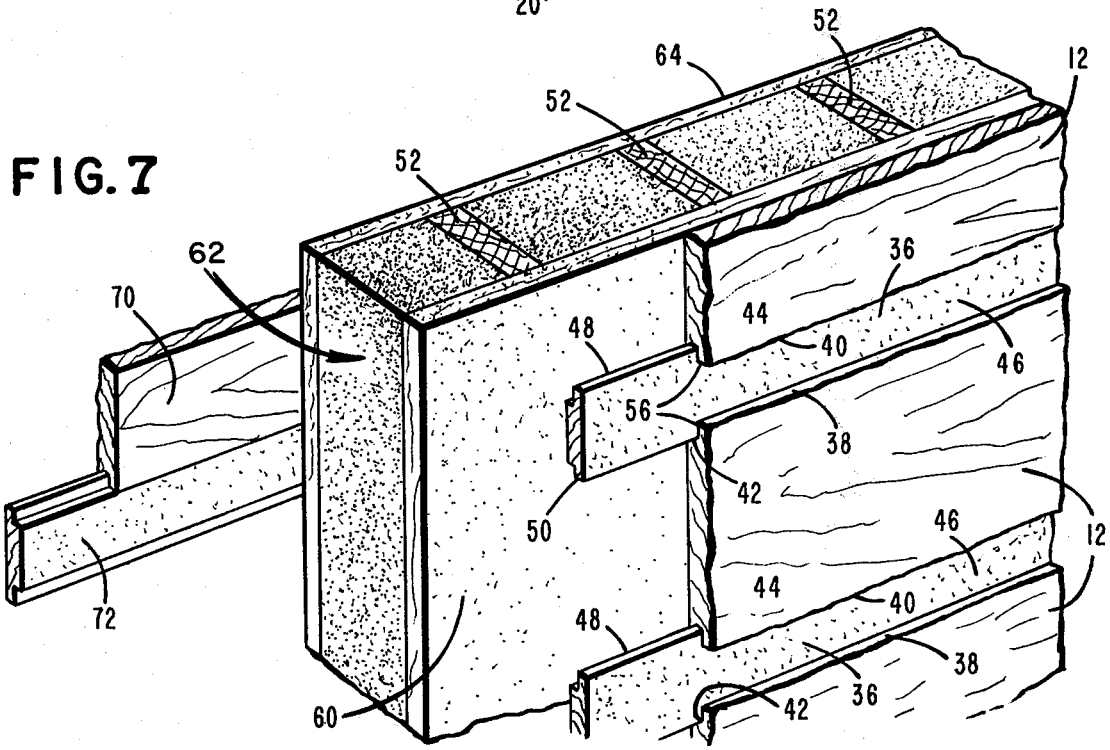
FIG. 7 shows an alternate assembly of a mortar joint spacer element positioned between two adjacent log facing elements having running grooves positioned in the top and bottom edges of the log facing board with the surface of the edge of the groove being of irregular form as opposed to a straight line to simulate a log in contact with its mortar joint, and showing inside log facing elements and mortar joint spacer elements positioned opposite to corresponding outside elements.

FIG. 7 shows an alternate mortar joint spacer in which spaced log facing elements have in the top and bottom edges 38 and 40 thereof longitudinal grooves 42 and 44, respectively. The top surface of the edges 38 and 40 of the log facing are irregular in form as opposed to a smooth horizontal straight edge.

Positioned between adjacent spaced log facing elements 12 is a mortar connector or mortar joint spacer element 46 that has top and bottom edge tongs or lips 48, 50 adapted to fit into grooves 42, 44. The grooves 42, 44 can be of U-shaped configuration. In assembly, a conventional stud frame, having in place of the standard corner posts the dovetailed corner post element 16, is erected so as to receive the log facing elements 12 and the connector elements 46.

Between adjacent log facing elements 12 is positioned the connector element 46 which is held in place by insertion of tongs 48,50 in grooves 42,44 and by nails 36 which are driven through the connector into studs 52.

Figure 5:
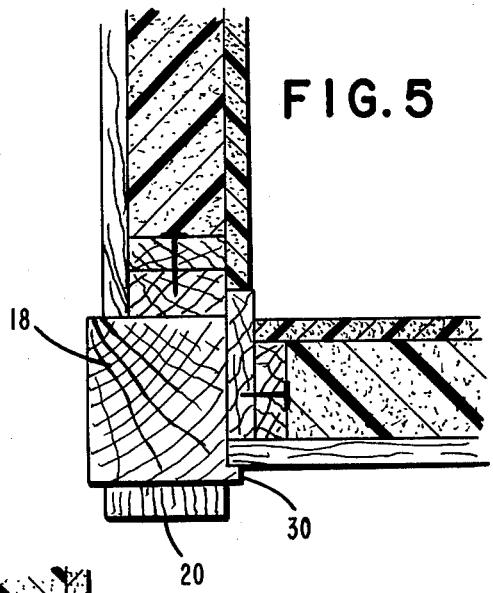
FIG. 5 is a cross-sectional view taken on the line 5—5 of FIG. 4 showing back-up boards to which the cut blocks are attached, and the lip portion of one corner block with an end of a log veneer board positioned under it.
Figure 6:
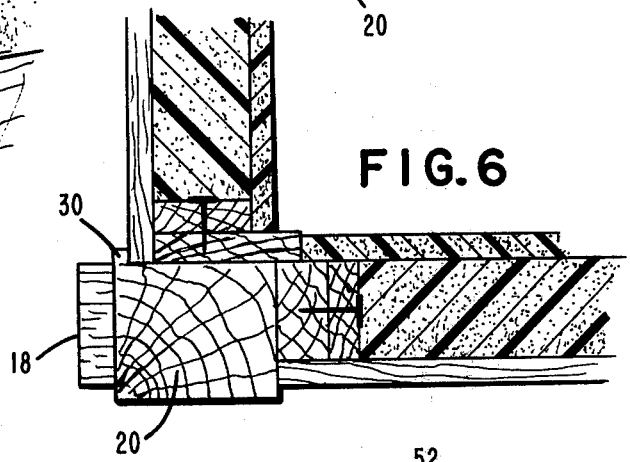
FIG. 6 is a cross-sectional view taken on the line 6—6 of FIG. 4 showing back-up boards to which the cut blocks are attached, and the lip portion of one corner block with an end of a mortar joint spacer element positioned under it.

In this construction, the log facing elements 12 are held in place without nails being driven through them. Thus any shrinkage in the width of the log facing elements does not show a pullaway line from the mortar connector since the legs of the grooves 42 and 44 can slide over the surface of the tongs 48, 50. The ends of the log facing elements 12 and the ends of connector elements 46 abut against the corner blocks 18, 20 in the manner heretofore described and as shown in FIGS. 5 and 6.

The mortar connector 46 may be formed from any type of board or plywood and may be precoated with an epoxy mortar. The elasticity of the epoxy mortar joints also allows the log facing elements to shrink without opening up cracks between the connector elements and the log facing elements.

Also, the outside leg 56 of the grooves 42, 44 may be varied in length from log facing element to log facing element, thus providing the effect of variable width in the mortar joints, and the edge surface of the outside leg 56 can be irregularly surfaced to give it an unsmoothed and hand-hewn effect providing a pleasing rustic appearance to the wall surface of the building.

It will be appreciated, of course, that any type of mortar can be used to coat the connector that is elastic in nature and will adhere to the surface of the connector.

The log facing elements can be formed from board cut about one inch in thickness, but can be made thinner or thicker as desired so that, when assembled by the method of this invention and fitted against the dovetailed corner post, gives the appearance of a structure constructed from full, thick logs. Also, the log facing elements can be of veneer board and have a width of from about 8 inches to about 12 inches.

The simulated log-type structure of this invention allows for the use of conventional framing and insulation. In FIG. 7 there is shown a typical partial wall section in which, to the outer surface of the studs 52 of the stud framing, is fastened a sheet of foam insulation 60. Between adjacent studs is positioned a 3½ inch fiber blanket insulation 62 to provide for a high R value that produces energy conservation. The log facing element 12 and mortar connector 46 covering the foam insulation 60 are held in place by suitable fastening means such as nails 36 which are driven through mortar connector 46 and the insulation 62 into the studs 52. If desired, an inner covering of half-inch gypsum board 64 can be fastened to the inner surface of stud 52 to provide one type of interior finish when painted. This construction provides a high insulation value of R-19 from a construction that is both economical and easy to build, but still gives the appearance of a rustic log-type structure.

It will be appreciated that the three elements of this invention can be attached to the stud framing of the building by nailing, stapling, glueing, or any other conventional attachment means usable in the building industry.

Advantageously, the inside surface of the walls can be finished to simulate the interior of a log-type building by attaching to the gypsum board 64 covering the stud frame a plurality of log facing elements 70 spaced by mortar connectors 72 which, if desired, may be positioned opposite and in the same relationship as the outside log facing elements, thus creating a total illusion of a building built from thick logs. When such a construction is made, the R values of the walls of the building are about R-20.

It will be appreciated that the wall construction of this invention has a higher R value than a building formed from thick logs. For example, a natural log would have to be from 18 to 20 inches thick to provide an R factor of 19 or 20.

It will also be appreciated that the log facing element can be any form of board, cut or pressed from wood chips or the like, that has an outer face that simulates a cut board or outer log surface; and that the corner element can be so constructed as to fit angular corners other than 90° by proper facing of the sides of the block at the desired angle to make the outside face of the alternately protruding blocks appear to be in line with the log facing element, thus presenting the appearance that the log facing element is a full thickness of log having a notched end portion.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. In a building wall structure having outer walls and corners that simulate log-type construction comprising: at least one corner element having a plurality of adjacent wedge-shaped blocks having alternate outer surfaces in angular contact relationship to each other, the outer angular surface in one block projecting beyond the outer angular surface of its adjacent block with each adjacent block at an angle with respect to each other and having an outwardly projecting end face that has an angular top edge and a straight bottom edge, and a plurality of log facing elements spaced one from the other by a mortar joint spacer element, each of said facing elements in each outer wall abutting a side of each of said wedge-shaped blocks, and each of said mortar joint spacer elements in each outer wall abutting only alternate wedge-shaped blocks that project outwardly beyond the surface of said spacer element.

2. The building structure of claim 1 in which said log facing elements, said mortar joint spacer elements, and said corner elements are attached to adjacent stud frame sections to form a section of log-type building structure.

3. The building structure of claim 1 in which said alternating wedge-shaped blocks are positioned and project at an angle of 90° with respect to each other.

4. The building structure of claim 1 in which said blocks are in two sets, each block having four parallel sides with two opposite sides wider than the others and the plane of the ends inclined at the same angle, the said plane of the angle of one end being disposed 90° to the plane of the angle of the other end, and the plane of the angle of one set of blocks being opposite to the plane of the angle of the other set of blocks, the blocks of one set alternately positioned and projecting at an angle with respect to the other set of blocks.

5. The building structure of claim 2 in which said mortar joint spacer elements are attached to the stud frame section and the log facing elements are held in place by said mortar joint spacer elements.

6. The building structure of claim 1 in which the mortar joint spacer element is coated with an elastomeric mortar.

7. The building structure of claim 6 in which the elastomeric mortar is an epoxy-containing mortar.

8. The building structure of claim 2 in which a layer of foam insulation is positioned between the study frame and said log facing elements, spaced by said mortar joint spacer elements.

9. The building structure of claim 1 in which said corner element is formed from a unitary piece of material with a form that simulates a stack of alternating wedge-shaped blocks.

10. The building structure of claim 1 in which said log facing elements are about one inch in thickness.

11. The building structure of claim 2 in which said wall sections are prefabricated and attached to said corner elements during assembly of said walls of said building.

12. The building structure of claim 1 in which said walls are attached to stud framing and have an inner wall surface formed from log facing elements spaced by mortar spacer elements.

13. The building structure of claim 2 in which the adjacent stud frame sections that form the outer walls and abut a corner element have an internal included angle between adjacent inner wall sections of less than 180°.

14. Building elements for constructing a simulated log-type building comprising three interconnectable sets of elements comprising a dovetailed plurality of corner element having alternate wedge-type projections disposed at a 90° angle to each other and adapted to be fastened to study frame sections of a building structure, a plurality of log facing elements, and a plurality of mortar joint spacer elements, each of said mortar joint spacer elements adapted to fit positionally in a top and bottom groove of two spaced log facing elements and end-abut against said corner element when fastened to a stud frame section.

15. A building structure having outer wall sections and corner constructions that simulate a log-type building comprising:

(a) a building structure having outer stud frame sections;

(b) vertical corner elements attached to the intersection of the outer stud frame section, each of said elements having a first and a second set of spaced wedge-shaped blocks, the blocks of one set alternately positioned and projecting at an angle with respect to the other set of blocks, each block having an outer vertical lip, said lip on one set of blocks positioned at an angle from the lip on the other set of blocks and extending parallel to the stud frame section that intersects the corner element;

(c) each corner element having a first outer wall and a second outer wall each attached to one of said frame sections intersecting said corner element, each wall having a plurality of spaced horizontal log facing elements, each log facing element having in the surface of the top and a bottom edge thereof a groove running horizontally the length thereof, each groove adapted to receive an edge portion of a mortar joint spacer element; the end of each of said spaced log facing elements in the first wall substantially positioned centrally with respect to a block of said first set and a part of each of the end portions of each log facing element fitting under said lip in each block of said first set, and the second wall attached to the other of said frame sections intersecting said corner element at an angle with respect to said first wall and having a part of each of the end portions of each log facing elements fitting under said lip in said blocks in each block of said second set, and the end of said mortar spacer elements abutting a block that projects angularly outward from the plane of said log facing element.

16. The building structure of claim 15 in which the groove running in the top and bottom of said log facing element is U-shaped having a width and depth capable of receiving the edge of a mortar joint spacer element.

17. The building structure of claim 16 in which the depth of the U-shaped groove is deeper in some of the log facing elements than in others so that the wall section appears to have a variation in width of the mortar joint spacer elements.

18. The building structure of claim 15 in which the surface of the edge defining said groove is irregular in edge shape so that when the edge of a mortar joint spacer element is inserted in the groove, the log facing element simulates an actual log.

* * * * *